US005927132A

United States Patent [19]

Rupoli

[11] Patent Number: 5,927,132

[45] Date of Patent: Jul. 27, 1999

[54] METHOD OF BENDING BARS

[75] Inventor: Simone Rupoli, Fano, Italy

[73] Assignee: Schnell Spa, Italy

[21] Appl. No.: 09/069,715

[22] Filed: Apr. 30, 1998

[51] Int. Cl.[6] ..... B21D 7/022; B21D 11/12

[52] U.S. Cl. ..... 72/306; 72/388; 72/217

[58] Field of Search ..... 72/306, 307, 388, 72/387, 217–219, 149

[56] References Cited

U.S. PATENT DOCUMENTS

| | | | |
|---|---|---|---|
| 1,795,188 | 3/1931 | Wagenbach | 72/388 |
| 2,055,955 | 9/1936 | Wagenbach | 72/388 |
| 3,803,893 | 4/1974 | Peddinghaus | 72/306 |
| 3,857,271 | 12/1974 | Gott | 72/306 |
| 4,702,097 | 10/1987 | Zahlaus | 72/306 |
| 5,144,829 | 9/1992 | Fabro et al. | 72/294 |
| 5,375,447 | 12/1994 | Del Fabro et al. | 72/307 |
| 5,537,852 | 7/1996 | Del Fabro et al. | 72/387 |

FOREIGN PATENT DOCUMENTS

| | | | |
|---|---|---|---|
| 349953 | 1/1990 | European Pat. Off. | 72/306 |
| 510266 | 10/1930 | Germany | 72/387 |
| 165519 | 12/1981 | Japan | 72/306 |
| 641865 | 8/1950 | United Kingdom | 72/388 |
| 1435033 | 5/1976 | United Kingdom | 72/306 |

OTHER PUBLICATIONS

Schnell Robomaster Brochure, 10 pages.

*Primary Examiner*—Daniel C. Crane
*Attorney, Agent, or Firm*—Young & Basile, P.C.

[57] ABSTRACT

A method of bending a bar into a sinusoidal configuration. The method employs a bending machine comprising a table having a fixed central post defining a slot for receipt of the bar, a turntable positioned rotatably around the post, a pair of bending pins on the turntable, and a pair of abutment pins on the table radially outwardly of the turntable. With the front end of the bar clamped fixedly and the bending machine positioned at the rear end of the bar, the turntable is rotated to place a compound bend in the bar utilizing a first bending pin and a first abutment pin whereafter the bending machine is moved forwardly along the bar to a first indexed location at which the turntable is rotated in an opposite direction to place a reverse compound bend in the bar utilizing the second bending pin and the second abutment pin. The bending machine is moved successively along the bar to successive indexed locations and a compound bend is placed in the bar at each indexed location with each compound bend comprising a mirror image of the preceding compound bend so that a sinusoidal configuration is imparted to the bar.

16 Claims, 3 Drawing Sheets

16
10
18
14

METHOD OF BENDING BARS

BACKGROUND OF THE INVENTION

This invention relates to a method of bending and more particularly to a method of bending a bar into a predetermined configuration.

Methods and machinery for bending bars into predetermined configurations are well known and in common usage. In particular, methods and machinery are known for bending bars into a predetermined sinusoidal configuration for use in reinforcing concrete beams. Whereas these prior art methods and machinery are generally satisfactory and are in common use, they require an inordinate amount of floor space to process and bend a bar of a given length; they require significant numbers of operators to attend the machinery for a given bending operation; and they are extremely limited in the number of bars that can be produced in a given unit of time.

SUMMARY OF THE INVENTION

This invention is directed to an improved methodology for bending a bar.

More particularly, this invention provides a method of bending elongated bars wherein the amount of floor space required to produce the desired bending operation is significantly reduced; the number of operators required to perform the bending operation is reduced; and the number of bars that can be satisfactorily bent in a given unit of time is increased.

According to the invention, a bending machine is provided moveable forwardly along an axial path from a rear starting location to a front finish location; the bending machine is positioned at the starting location; a bar is positioned along the path with a rear end of the bar positioned proximate the bending machine and a front end of the bar positioned proximate the front finish location of the path; the bar is fixed against movement along the path; a bend is placed in the rear end of the bar using the bending machine; the bending machine is moved forwardly along the fixed bar and along the path to a first index location; a bend is placed in the bar at the first indexed location using the bending machine; the bending machine is moved forwardly along the fixed bar and along the path to successive indexed locations; and a bend is placed in the bar at each successive indexed location using the bending machine. With this arrangement, the bending machine is able to work successively forwardly along the fixed bar to impart the desired configuration to the bar utilizing a minimum amount of floor space.

According to a further feature of the invention, the step of fixing the bar comprises clamping the front end of the bar. This specific methodology for fixing the bar simplifies and optimizes the forward movement of the bending machine along the fixed bar.

According to a further feature of the invention, the bend provided in the bar at one location along the path comprises a compound bend including a clockwise bend followed by a reverse counter clockwise bend and the bend produced at the next successive location along the path comprises a compound bend including a counter clockwise bend followed by a reverse clockwise bend. This specific methodology imparts a sinusoidal configuration to the bar.

According to a further feature of the invention, the bending machine comprises a table having a fixed central post defining an axial slot for receipt of the bar, a turntable positioned rotatably around the post, a bending pin on the turntable, and an abutment pin on the table radially outwardly of the turntable; the bar moves slideably in the axial slot in the post as the bending machine moves forwardly along the bar; and each step of placing a bend in the bar comprises rotating the turntable to bring the bending pin into engagement with the bar portion upstream of the post and bend the upstream bar portion against the abutment pin, and thereafter rotating the turntable further to cause the bending pin to coact with the abutment pin to place a reverse bend in the upstream bar portion. The use of this specific bending machine to carry out the invention methodology facilitates the placement of the desired compound reverse bends in the bar.

According to a further feature of the invention, the table is defined by a carriage mounted for movement along track means extending along the path. This specific arrangement facilitate the forward movement of the bending machine along the path to impart the successive bends to the bar at the successive indexed locations.

According to a further feature of the invention, a trailer is provided moveable along track means rearwardly of the carriage to support the rear end of the bar. This arrangement provides a ready and efficient means for containing and supporting the rear end of the bar as the bar is bent.

According to further feature of the invention, the front end of the bar is clamped by a further bending machine fixedly positioned at the front finish location. This arrangement provides a moveable and a fixed bending machine which may be useable in combination to impart various desired configurations to the bars.

DETAILED DESCRIPTION OF THE PREFERRED EMBODIMENT

Figures 1, 2:
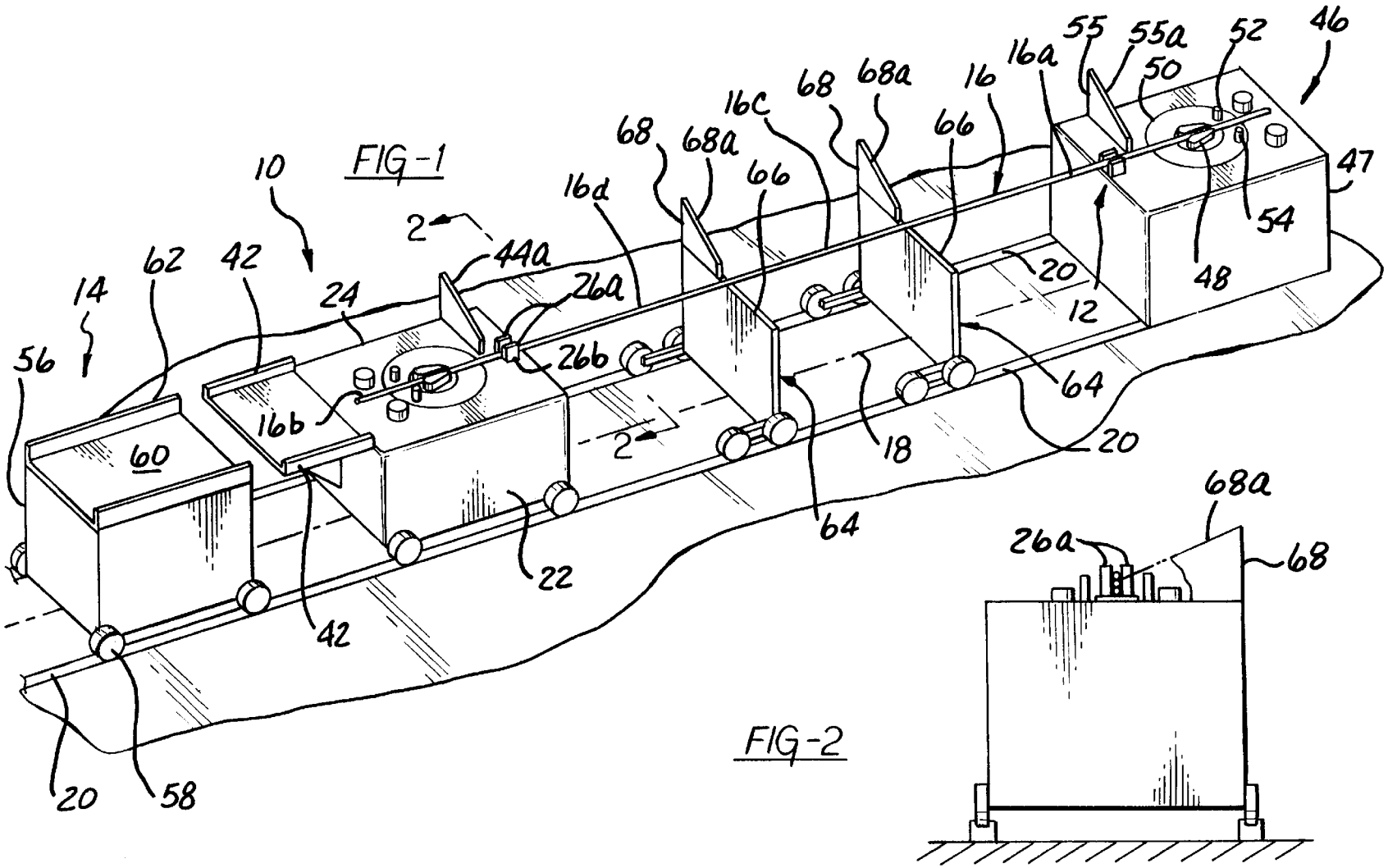
FIG. 1 is a perspective somewhat schematic view of machinery for carrying out the invention methodology.
FIG. 2 is a cross-sectional view taken on line 2—2 of FIG. 1.
Figure 3:
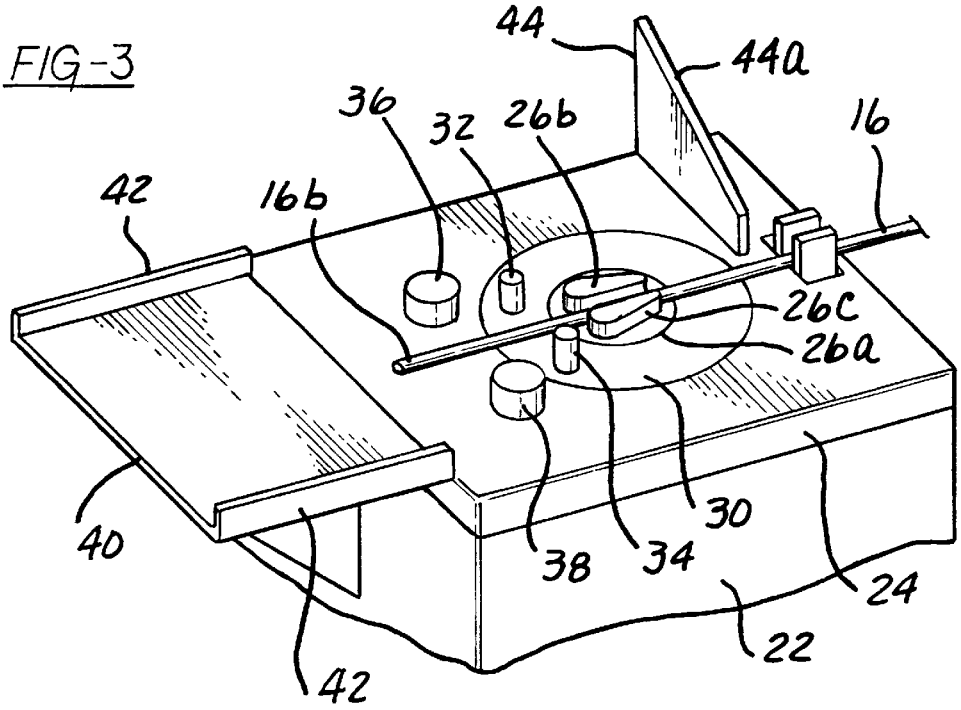
FIG. 3 is a detailed perspective view of a bending machine utilized in carrying out the invention methodology.

The methodology of the invention is carried out utilizing a bending machine 10, a clamp device 12, and a trailer 14.

Broadly considered, a front end 16*a* of a bar 16 is clamped by the clamp device 12 with the rear end 16*b* of the bar engaged by the bending machine 10 and the bending machine moves forwardly along the bar along a path 18 on spaced rails 20 to successively bend the bar at successive indexed positions along the path with the trailer 14 moving along the rails behind the bending machine to support the rear, bent end of the bar.

Bending machine 10 comprises a carriage 22 moveable along rails 20 utilizing wheels 23; a table top 24 carried by the carriage; a center post 26 upstanding centrally from the table top; a turntable 30 positioned concentrically around post 26 and mounted for rotary movement about the central axis of the post; left and right bending pins 32, 34 upstanding from the turntable at circumferentially spaced locations rearwardly of post 26; left and right abutment pins 36, 38 fixedly upstanding from table top 30 at circumferentially spaced locations rearwardly and laterally outwardly of bending pins 32, 34; an apron 40 projecting rearwardly from the table top, forming a rearward extension of the upper surface of the table top, and including upstanding lateral walls 42; a clamp mechanism 42 positioned at the front edge 24*a* of the table top and including left and right clamp halves 42*a*, 42*b*; and a loading plate or ramp 44 positioned on the table top 24 between turntable 30 and clamping mechanism 42 on the left side of the table top and defining an angled loading surface 44*a*. Post 26 includes post halves 26*a*, 26*b* coacting to define an axial slot 26*d* therebetween for sliding receipt of a bar and each having a rounded front end 26*e* to impart a desired bend configuration to a bar.

Clamp device 12 may comprise a simple, independent clamp mechanism or, as shown, may comprise the clamping mechanism of a bending machine 46 fixedly positioned at the forward end of path 18 and further including a table top 47, a split center post 48 upstanding from table top 47, a turntable 50 mounted for rotation about post 48, circumferentially spaced bending pins 52, 54 on turntable 50, and a loading plate or ramp 55 positioned on the left side of the table top 47 between clamp mechanism 12 and turntable 50 and defining an angled loading surface 55*a*.

Trailer 14 comprises a carriage 56 positioned behind bending machine 10 and mounted for rolling movement along rails 20 on wheels 58. Trailer 14 defines an upper support surface 60 flanked by upstanding sidewalls 62. Surface 60 is coplanar with the upper surface of table top 24 of bending machine 10 and walls 62 are in respective axial alignment with walls 42.

The machinery for carrying out the invention may further include a plurality of support frames 64 rollably mounted on rails 20 between bending machine 10 and clamp device 12 and defining upper support surf aces 64*a* to support mid-portions bars 16 and further each defining an angled loading plate or ramp 68 defining an angled loading surface 68*a*.

OPERATION

In the operation of the illustrated machinery to carry out the invention methodology, with bending machine 10 positioned at a rear starting location proximate the rear end of the bar, a bar 16 of round stock is positioned on loading surfaces 44*a*, 68, 68*a*, and 55*a* and allowed to roll down the surfaces and into a position in which the rear end 16*b* of the bar is positioned in slot 26*d*, the front end 16*a* of the bar is positioned on table top 47 between clamp halves 12*a* and 12*b*, and intermediate portions 16*c* of the bar are supported on support surfaces 66 of support frames 64.

Figure 4:
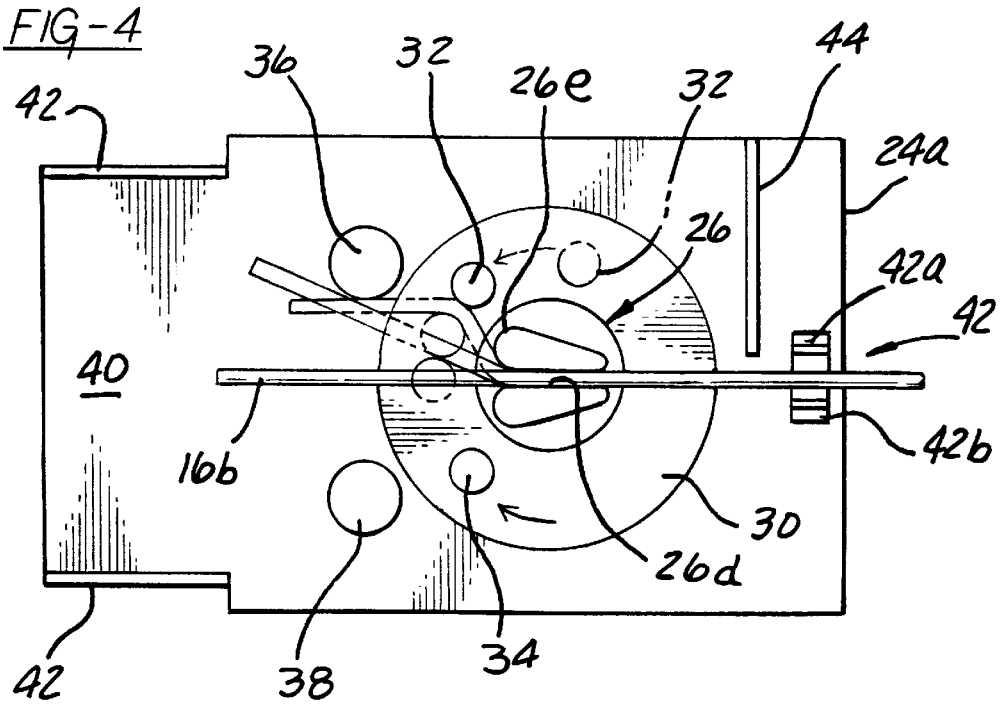
FIG. 4 is a top view of the bending machine.

Clamp halves 12*a* and 12*b* are now moved into clamping engagement with the front end 16*a* of the bar and clamp halves 42*a*, 42*b* are moved into clamping engagement with the bar portion 16*d* positioned proximate the forward edge of table top 24. As best seen in FIG. 4, turntable 30 is now rotated in, for example, a clockwise direction to bring right bending pin 34 into engagement with rear bar portion 16*b*, upstream of the central post 26 to bend the rear, upstream bar portion against left abutment post 36 as seen in dash lines in FIG. 4 whereafter, with continued rotation of the turntable in the clockwise direction, pin 34 coacts with the rounded front end 26*e* of post half 26*b* and with abutment pin 36 to place a reverse bend in the rear, upstream bar portion as seen in dotted lines in FIG. 4. It will be seen that a compound bend has now been placed in the rear end of the bar comprising a clockwise bend portion and a reverse counter-clockwise bend portion.

Figures 5, 6, 7, 8, 9, 10:
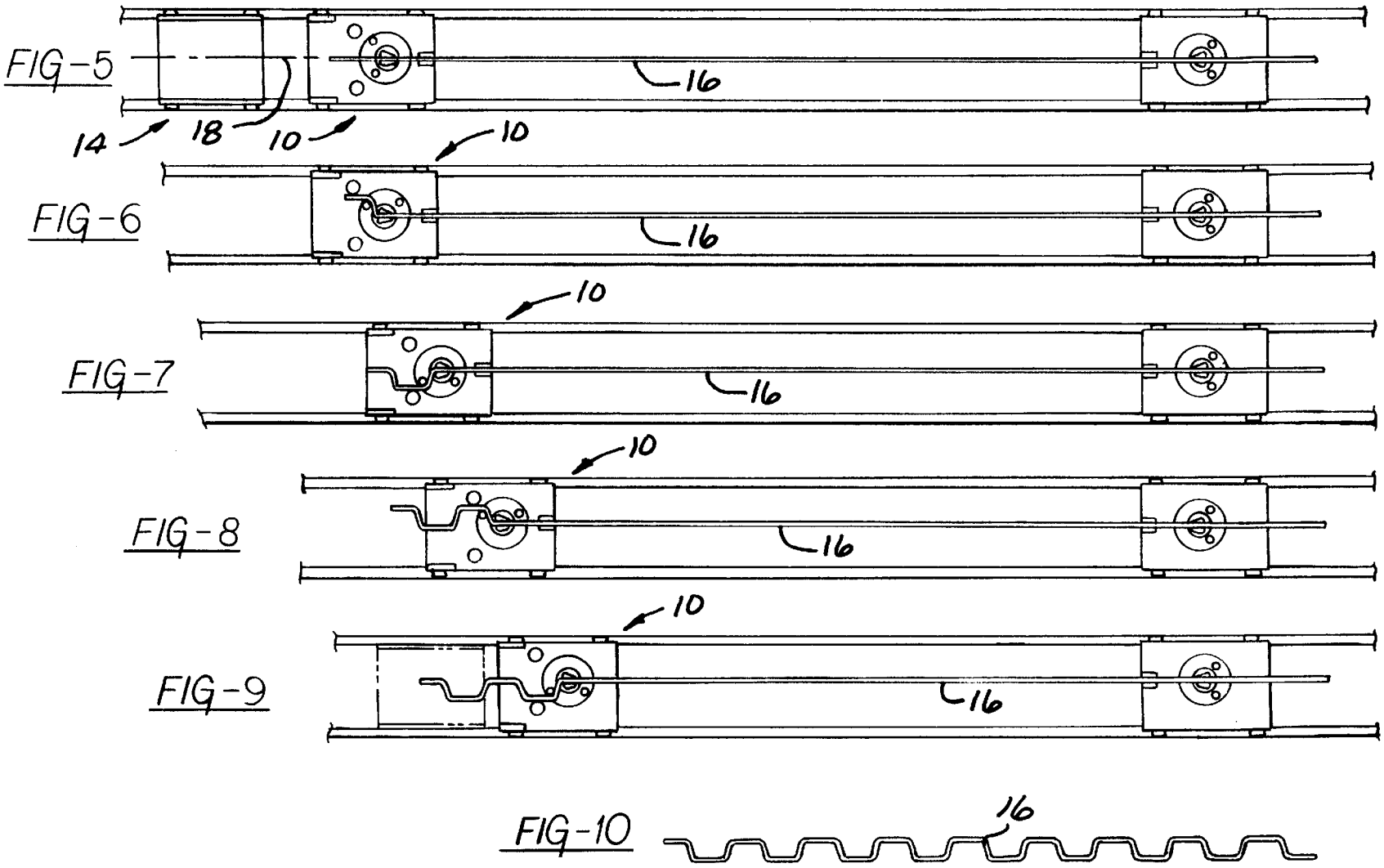
FIGS. 5, 6, 7, 8, and 9 are successive top views showing successive steps in performing the invention methodology.
FIG. 10 is a view of a bar processed in accordance with the invention methodology.

Clamps 42*a*, 42*b* are now released while continuing to clamp the front end of the bar with clamps 12*a* and 12*b* and the bending machine 10 is moved forwardly along path 18 and along fixed bar 16 to a first indexed location seen in FIG. 5. As the bending machine moves forwardly along the path, bar 16 slides axially in slot 26*d*. The forward indexing movement of the carriage may be accomplished in any of several known ways including power cylinders or cables. Upon arrival of the bending machine at the first indexed position, clamps 42*a*, 42*b* are re-engaged with the bar and the turntable 30 is rotated in a counter-clockwise direction so that left bending pin 32 coacts with the rounded front end 26*e* of the post half 26*c* and with right abutment post 38 to place a compound bend in the bar that is a mirror image of the reverse compound bend placed in the bar at the rear starting location. Clamp halves 42*a* and 42*b* are again released while continuing to clamp the forward end of the bar and the bending machine is moved forwardly to a second indexed location whereat clamps 42*a*, 42*b* re-engage the bar and the table is rotated in a clockwise direction to allow bending pin 34 and abutment post 36 to coact to place a compound bend in the bar which is essentially identical to the compound bend placed in the bar at the rear starting location. This procedure is repeated at each indexed location, alternating clockwise and counter-clockwise rotation of the turntable, until the bending machine arrives at a front finish location proximate fixed bending machine 46, at which location a final compound bend is placed in the bar. The entire bar has now been processed and, specifically, the entire bar has been bent into a sinusoidal configuration as seen in FIG. 10. Clamp halves 42*a*/42*b* and 12*a*/12*b* are now released and the sinusoidally bent bar is suitably discharged from the bending machine utilizing, for example, pivoting unloading arms (not shown) to engage the underside of the bent bar, lift the bar, and roll the bar to a discharge location on the right side of the machine.

Although the invention methodology has been described as being performed on a single bar 16*a*, more typically a plurality of vertically stacked bars, as seen in FIG. 2, will be processed and bent simultaneously.

As bending machine 10 moves in indexing fashion along path 18 toward the fixed end of the bar, trailer 14 is moved along the rails 20 behind the bending machine to support the rear, bent end of the bar and specifically to provide lower support for the bar and, via sidewalls 62, limit the flailing action of the bar as the bar is bent at each successive indexed location. Trailer 14 may be coupled to bending machine 10 so as to move with the bending machine or as shown, may move independently of the bending machine in a manner to continue to support the rear end of the bar and restrain flailing of the rear end of the bar as the successive bends are made. Support frame 64 will be understood to move selectively along rails 20 as the bending machine 10 moves toward and ultimately approaches the clamped end of the bar with the support frames in the finished or final configuration of the machinery being essentially clamped between the front face of bending machine 10 and the rear face of bending machine 46 whereby to allow substantially the entire length of bar 16 to be bent as described in sinusoidal fashion.

As noted, clamping mechanism 12 may comprise a free standing independent device. However, it is preferable to provide the clamp mechanism, as shown, as a part of a further bending machine 46 so that bending machines 10 and 46 may act in combination to impart other and different configurations to a bar utilizing selective combinations of the bending apparatus provided by the machine 10 and the bending apparatus provided by the machine 46.

The powered rotation of the turntable 30 and the powered clamping action of the clamp mechanisms 42 and 12 are performed in known manner utilizing known bending machine technology.

It will be understood that the sinusoidally bent bar 16 may have various applications but most typically will be used as a reinforcing element in a concrete structure.

The methodology of the invention will be seen to provide many important advantages. Specifically, since the bar 16 does not move during the bending operation the floor space requires to perform the bending operation need only be substantially as long as the bar being bent. Further, the invention methodology lends itself to automation with the result that fewer operators are required to carry out the methodology as compared to prior art methodologies. Further, the invention methodology, by virtue of its simplicity and by virtue of its amenability to automation, provides a greater throughput of bars per unit time than prior art methodologies.

Although a preferred embodiment of the invention has been illustrated and described in detail it will be apparent that various changes may be made in the disclosed embodiment without departing from the scope or spirit of the invention.

What is claimed is:

1. A method of bending a bar comprising:

providing a bending machine moveable forwardly along an axial path from a rear starting location to a front finish location;

positioning a bending machine at the starting location;

positioning a bar along the path with a rear end of the bar positioned proximate the bending machine and a front end of the bar positioned proximate the front finish location of the path;

fixing the bar against movement along the path;

placing a reverse compound bend in the rear end of the bar using the bending machine;

moving the bending machine forwardly along the fixed bar and along the path to a first indexed location;

placing a reverse compound bend in the bar at the first indexed location using the bending machine;

moving the bending machine along the fixed bar and along the path to successive indexed locations; and placing a reverse compound bend in the bar at each successive indexed location using the bending machine.

2. A method according to claim 1 wherein the step of fixing the bar comprises clamping the front end of the bar.

3. A method according to claim 2 wherein the reverse compound bend provided in the bar at one location along the path comprises a clockwise bend followed by a reverse counter-clockwise bend and the reverse compound bend provided at the next successive location along the path comprises a counter-clockwise bend followed by a reverse clockwise bend, whereby to impart a sinusoidal configuration to the bar.

4. A method according to claim 1 wherein a plurality of bars are positioned along the path in vertically stacked relation and simultaneously bent.

5. A method of bending a bar comprising:

providing a bending machine moveable forwardly along an axial path from a rear starting location to a front finish location;

positioning a bending machine at the starting location;

positioning a bar along the path with a rear end of the bar positioned proximate the bending machine and a front end of the bar positioned proximate the front finish location of the path;

fixing the bar against movement along the path by clamping the front end of the bar;

placing a bend in the rear end of the bar using the bending machine;

moving the bending machine forwardly along the fixed bar and along the path to a first indexed location;

placing a bend in the bar at the first indexed location using the bending machine;

moving the bending machine along the fixed bar and along the path to successive indexed locations; and placing a bend in the bar at each successive indexed location using the bending machine;

the bend placed in the bar at each location along the path comprising a compound bend including a bend in a clockwise direction and a reverse bend in a counter-clockwise direction;

the bending machine comprising a table having a fixed central post defining an axial slot for receipt of the bar, a turntable positioned rotatably around the post, a bending pin on the turntable, and an abutment pin on the table radially outwardly of the turntable;

the bar moving slidably in the slot as the bending machine moves forwardly along the bar;

each step of placing a bend in the bar comprising rotating the turntable to bring the bending pin into engagement with the bar portion upstream of the post and bend the upstream bar portion against the abutment pin, and thereafter rotating the turntable further to cause the bending pin to coact with the abutment pin to place a reverse bend in the upstream bar portion.

6. A method according to claim 5 wherein the table is defined by a carriage mounted for movement along track means extending along the path.

7. A method according to claim 6 wherein a trailer is provided movable along the track means rearwardly of the carriage to support the rear end of the bar.

8. A method according to claim 6 wherein the front end of the bar is clamped by a further bending machine fixedly positioned at the front finish location.

9. A method of bending a bar utilizing a bending machine mounted for movement along an axial path and including a table defining a table top, a post upstanding from the table top and defining an axial slot sized to slidably receive a bar, a turntable positioned on the table top in surrounding relation to the post and rotatable about the post, a pair of circumferentially spaced first and second bending pins on the turntable, and a pair of circumferentially spaced first and second abutment pins upstanding from the table top radially outwardly of the turntable, the method comprising:

positioning a bar along the path;

clamping a forward end of the bar at a front end of the path;

positioning a rear end of the bar in the slot;

rotating the turntable in a first direction to bring the first bending pin into engagement with a bar portion upstream of the post to bend the upstream bar portion against the first abutment post;

continuing to rotate the turntable in the first direction to place a reverse bend in the upstream bar portion;

moving the bending machine forwardly along the bar and along the path to an indexed location;

rotating the turntable in a second, opposite direction to bring the second bending pin into engagement with a further bar portion upstream of the post to bend the further upstream bar portion against the second abutment post;

continuing the rotation of the turntable in the second direction to place a reverse bend in the further upstream bar portion;

moving the bending machine along the bar and along the path to successive indexed locations; and at each indexed location, rotating the turntable in a first or second direction to generate bending actions by coaction of the first or second bending pin with the first or second abutment pin, respectively, whereby to impart a sinusoidal configuration to the bar.

10. A method according to claim 9 wherein the bending pins have a rest position rearwardly of the post and the abutment pins are positioned rearwardly and laterally of the bending pins.

11. A method according to claim 9 wherein:

the table is defined by a carriage mounted for movement along track means extending along the path; and the carriage is powered for movement along the track means in an indexed fashion.

12. A method according to claim 11 wherein a trailer is provided moveable along the track means rearwardly of the carriage to support the rear end of the bar.

13. A method according to claim 11 wherein the forward end of the bar is clamped by a further bending machine fixedly positioned at a front end of the path.

14. A method according to claim 13 wherein a plurality of bars are positioned along the path in vertically stacked relation and simultaneously bent.

15. A method of bending a bar comprising:

providing a bending machine moveable forwardly along an axial path;

positioning a bar along the axial path;

fixing the bar against movement along the path;

using the bending machine to place a first compound bend in the bar at a first location along the path including a clockwise bend followed by a counter-clockwise bend;

moving the bending machine forwardly along the fixed bar and along the path to a second location; and using the bending machine to place a second compound bend in the bar at the second location including a counter-clockwise bend followed by a clockwise bend.

16. A method according to claim 15 wherein:

the clockwise and counter-clockwise bends comprising the first compound bend are placed in the bar simultaneously; and the counter-clockwise and clockwise bends comprising the second compound bend are placed in the bar simultaneously.

* * * * *